US005449135A

United States Patent [19]

Henderson

[11] Patent Number: 5,449,135

[45] Date of Patent: Sep. 12, 1995

[54] KITES

[76] Inventor: Anthony A. Henderson, P.O. Box 8192, Riccarton, Christchurch, New Zealand

[21] Appl. No.: 211,307

[22] PCT Filed: Sep. 30, 1992

[86] PCT No.: PCT/GB92/01795

§ 371 Date: May 31, 1994

§ 102(e) Date: May 31, 1994

[87] PCT Pub. No.: WO93/06905

PCT Pub. Date: Apr. 15, 1993

[30] Foreign Application Priority Data

Sep. 30, 1991 [NZ] New Zealand ..... 237989

[51] Int. Cl.[6] ..... B65C 31/06

[52] U.S. Cl. ..... 244/153 R; 244/155 R

[58] Field of Search ..... 244/153 R, 155 R, 155 H

[56] References Cited

U.S. PATENT DOCUMENTS

| | | | |
|---|---|---|---|
| 294,526 | 3/1884 | Stumpp | 244/153 R |
| 1,690,362 | 11/1928 | De Witt | 244/153 R |
| 3,314,630 | 4/1967 | Lewis, Sr. | 244/153 R |
| 3,315,922 | 4/1967 | Hull | 244/153 R |
| 3,570,790 | 3/1971 | Christoffel et al. | 244/153 R |
| 4,216,929 | 8/1980 | Holland | 244/153 R |
| 4,461,438 | 7/1984 | Pook et al. | 244/153 R |
| 4,658,843 | 4/1987 | Raymond | 244/153 R |
| 5,152,481 | 10/1992 | Cote et al. | 244/155 R |

FOREIGN PATENT DOCUMENTS

| | | |
|---|---|---|
| 2377746 | 8/1978 | France . |
| 2345162 | 3/1975 | Germany . |

*Primary Examiner*—Andres Kashnikow
*Assistant Examiner*—Virna Lissi Mojica
*Attorney, Agent, or Firm*—Christie, Parker & Hale

[57] ABSTRACT

A collapsible and foldable kite including frame members, a keel member, spreader supports and a sail. The frame members being fixed to the sail with the aa keel member and spreader supports either fixed to the sail and/or frame members, to brace the sail while flying. At least one of the frame members being hinged to allow the frame members and sail to be folded or rolled into a small package.

20 Claims, 5 Drawing Sheets

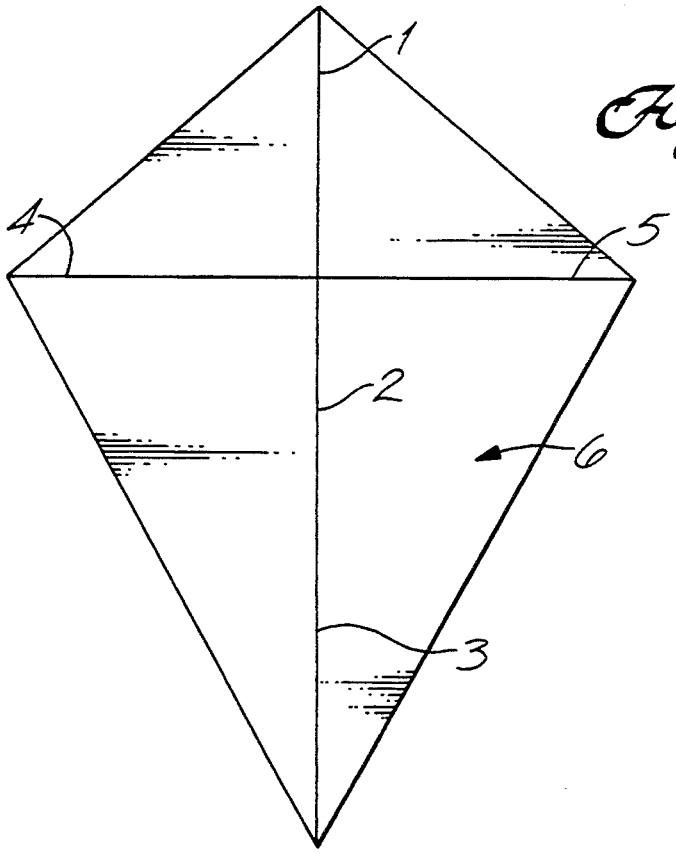
Fig. 4
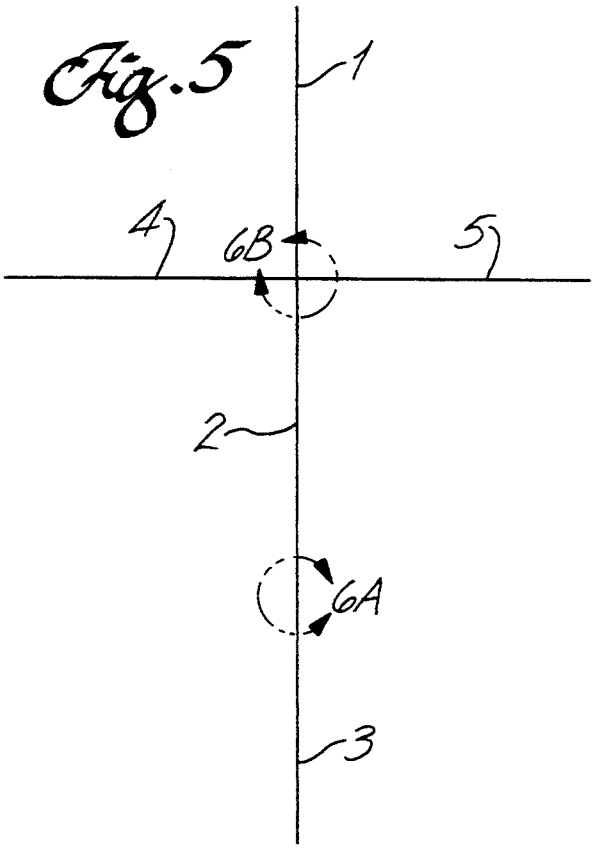
Fig. 5
Fig. 6A
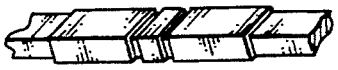
Fig. 6B
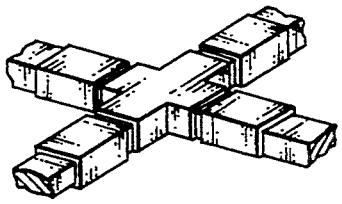

KITES

This invention relates to kites and more particularly to a readily collapsible, foldable and packagable kite.

At present kites are manufactured from rigid frame members and a sail constructed from a sheet material which is cut to a desired shape. From the bottom of the sail a tail or the like members extends. The frame normally consists of crossed members fixed relative to the sheet material by a variety of means, for example, by sleeves formed across or up and down on the sail. The kite includes a connection or connections for a tether line(s) by which the kite is controlled during flight.

A disadvantage of existing constructions of kitesis that when stored or packaged their size is constrained by the length of the rigid frame members.

A further disadvantage of existing kites is that prior to flight a preflight assembly operation is required.

An object of the invention is therefore to provide a readily collapsible, foldable and packagable kite the size of which is relatively small so that a convenient kite package is produced.

A further object of the invention is to provide a readily collapsible, foldable and packagable kite which offers a useful alternative choice.

According to a broadest aspect of the invention there is provided a collapsible and foldable kite including frame members, a keel member, spreader supports and a sail, the frame members being fixed to the sail with the keel member and spreader supports either fixed to the sail and/or frame members to brace the sail while flying, at least one of the frame members being hinged to allow the frame members and sail to be folded or rolled into a small package.

The frame members can be manufactured from wood or a plastics material which is formed, extruded or injection molded with a hinged joint therein.

The sail can be glued or if constructed from a plastics material can be heat welded or fixed with a self-adhesive tape to the frame members. The sail and frame members can be formed from the same material.

Further aspects of the invention which should be considered in all its novel aspects will become apparent from the following description which is given by way of example only.

An example of the invention will now be described with reference to the accompanying drawings in which:

FIG. 4 shows a schematic front view of a sail for the kite shown in FIG. 1;

FIG. 5 shows a front view of the frame members for the kite shown in FIG. 1;

Figure 1:
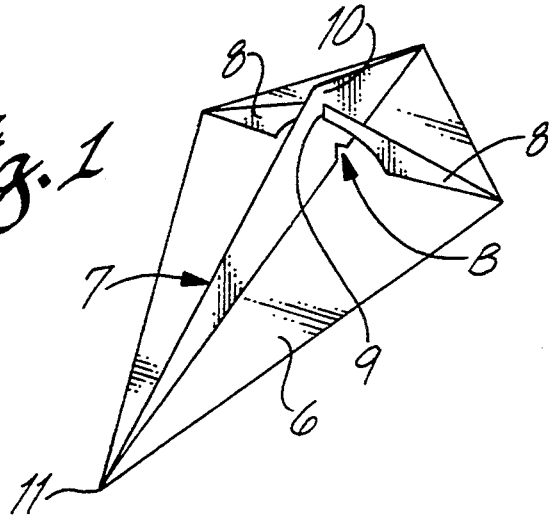
FIG. 1 shows a perspective view from the front of an example of kite according to the invention.
Figure 2:
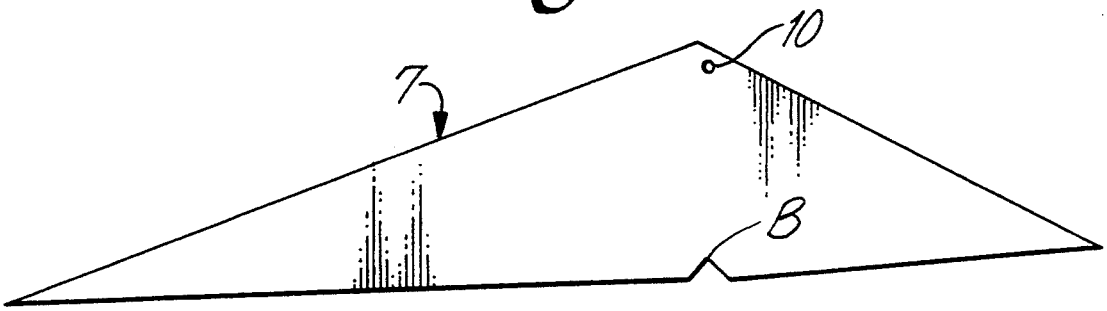
FIG. 2 shows a side view of a keel of the type fitted to the kite shown in FIG. 1.
Figure 3:
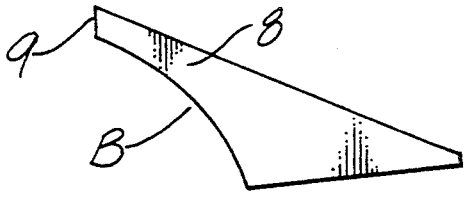
FIG. 3 shows a side view of a spreader member of the type fitted to the kite shown in FIG. 1.
Figure 7:
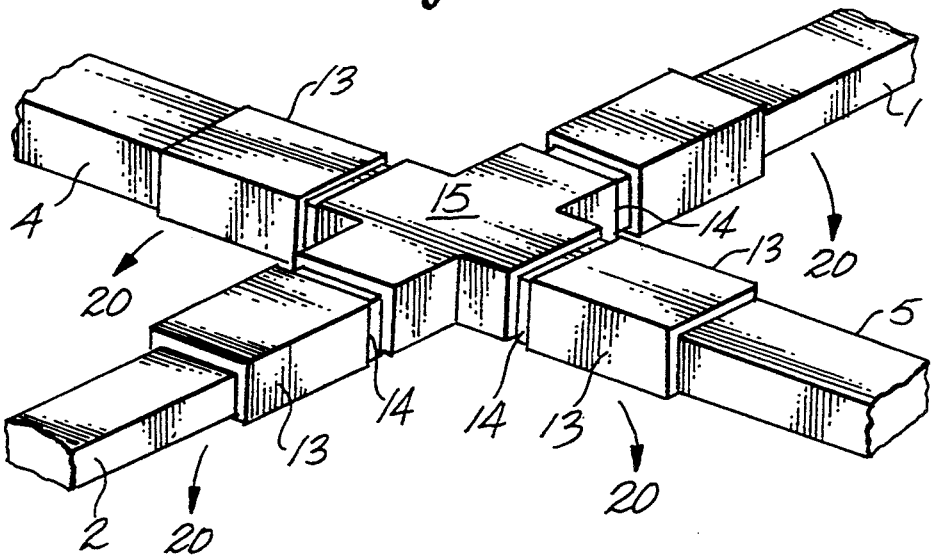
Figure 8:
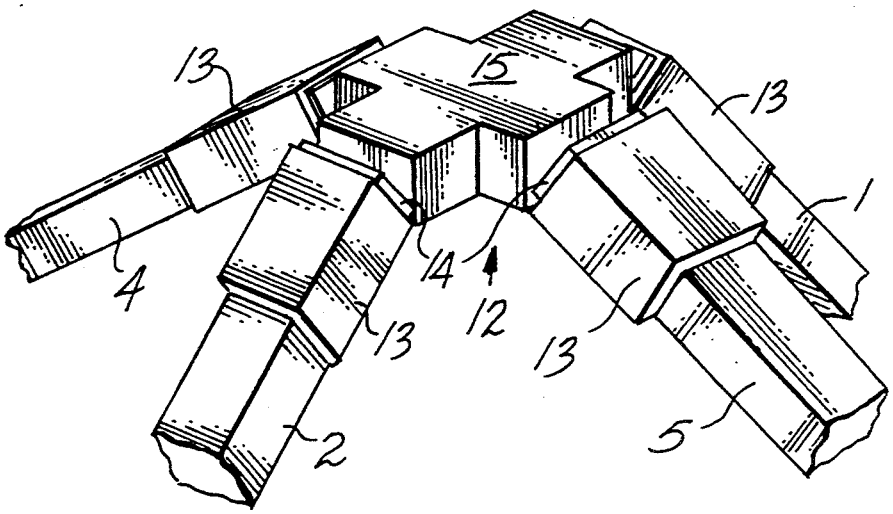
Figure 9:
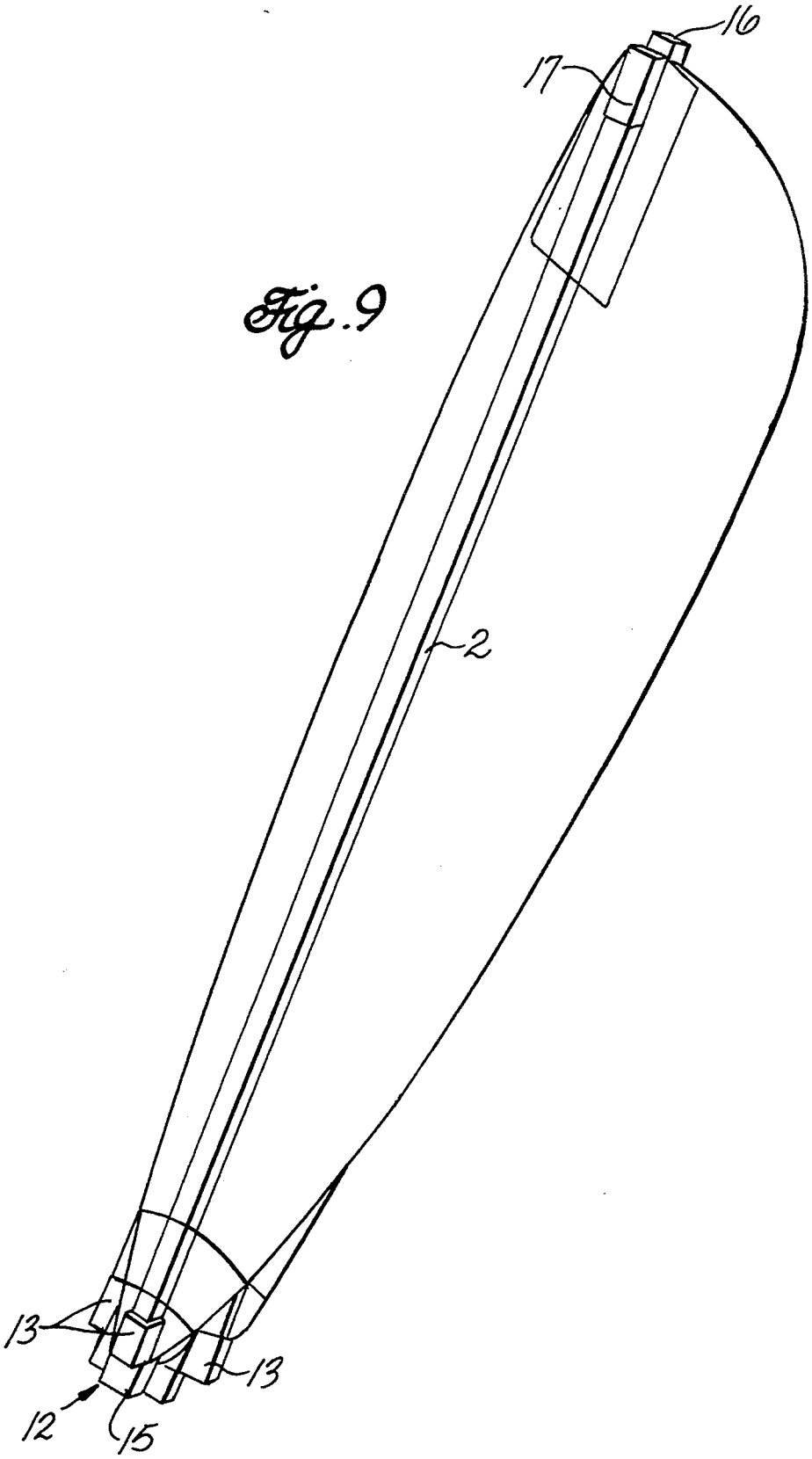
Figure 10:
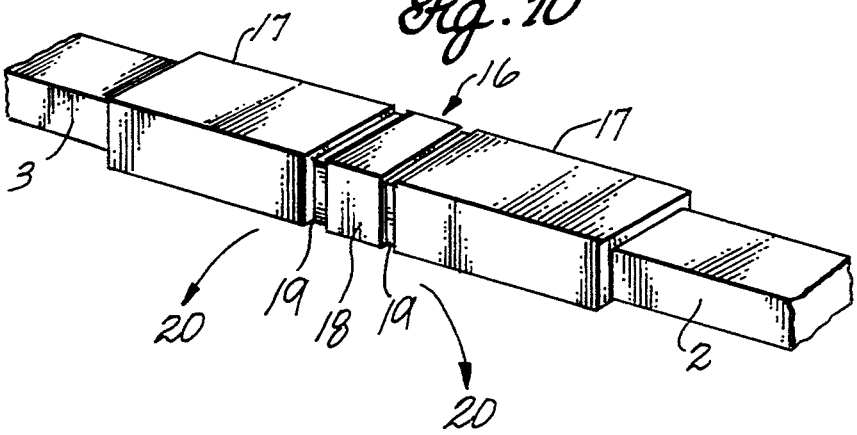
Figure 11:
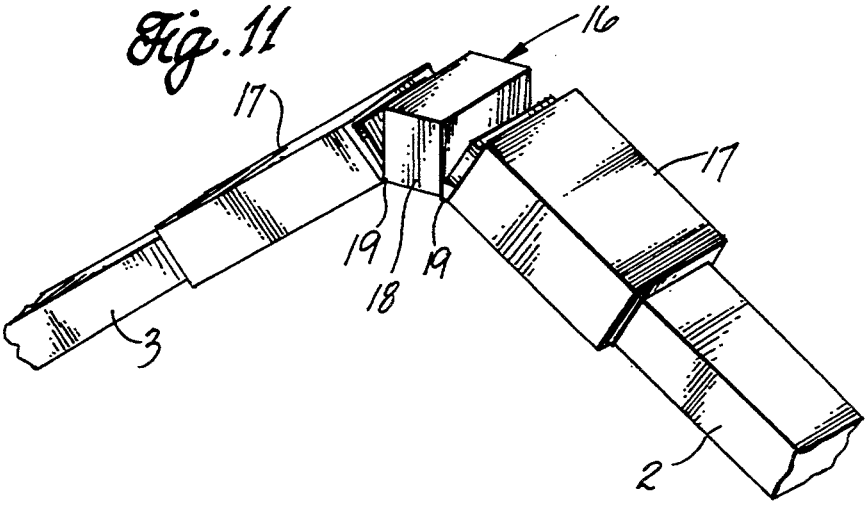

FIGS. 6A and 6B each show a detail on an enlarged scale of an example of the connection in the frame members at circles 6A, 6B respectively in;

FIG. 5 for the kite of FIG. 1;

FIG. 7 shows an enlarged perspective view of an example of molded connection for joining the members together;

FIG. 8 shows a view similar to that of FIG. 7 and showing the connection and attached frame members in a partly folded configuration;

FIG. 9 shows a perspective view of the kite show in FIGS. 1 to 6 in a folded and collapsed position;

FIG. 10 shows a perspective view of a connection suitable for joining the frame members at the point circle 6A in FIG. 5; and FIG. 11 shows a view similar to that of FIG. 10 with the frame members hinged from their erect position.

The example of the kite shown in the drawings is a conventional shape of kite which folds down to a size of 240 mm long by 25 mm round. It is however to be appreciated that with minor modifications the overall size of the kite and its shape can be varied. For example the kite can be square, round, oblong or diamond shaped all of which are foldable by providing appropriately shaped and dimensioned frame members, keel member and spreader members.

The kite shown in the drawings is 645 mm long, 480 mm wide with a 2.5 mm wide by 2000 mm long plastic tape tail (not shown) when opened and ready to fly.

The kite has a main frame formed from members 1, 2 and 3 and transverse members 4 and 5. The frame members can be formed from a variety of materials like wood or an extruded plastics material which can, for example, be 5 mm $\times$3 mm in cross-section.

The kite has a sail 6 which is glued, heat welded, or fixed with self-adhesive tape, directly to the frame members to create structural rigidity to the kite. Alternatively, a plastic sleeve can be welded over the frame to the sail to hold the parts together. Preferably the sail 6 is attached with self-adhesive tape to the frame members which fold inwards.

The kite has a keel member 7 and spreader supports 8 which are manufactured from a laminated plastics material. The supports 8 are welded to the keel at the line 9 in the center of the keel. The supports 8 and member 7 are welded to the front face of the sail along the line of the frame members.

A towing connection 10 is provided in the keel and this can have an eyelet in the plastics material to provide added strength to the point of connection for a tether line which can be a length of nylon line or the like. A tail (not shown) can be welded to the base 11 of the kite.

In FIGS. 7 and 8 is shown a connector 12 which can be injection molded from a plastics material. The connector 12 has four socket members 13. Into each socket member 13 is inserted an end of one of the frame members 1, 2, 4 and 5. Each of the socket members 13 is connected at 14 to a central hub 15. The connections at the points 14 are flexible to enable the members 1, 2, 4 and 5 to be hinged to lie alongside each other as shown in FIG. 9. The ends of the frame members 1, 2, 4 and 5 can be glued in friction fitted into their socket members 13.

The frame members 2 and frame member 3 can be joined at point A (FIG. 5) by a connector of the type shown in FIGS. 10 and 11. The connector is generally indicated by an arrow 16 and can be injection molded from a plastics material. The connector 16 has a pair of sockets 17 into which the ends of the members 2 and 3 fit. The sockets 17 are joined to member 18 by flexible webs 19.

When folding the kite, the members 2 and 3 are folded so that the lower end of the member 3 contacts region B of the spreader support. The members 1, 4 and 5 then collapse in the direction of arrows 20 in a similar fashion to an umbrella about the region B to the condition shown in FIG. 9. The fabric of the sail is then wrapped around the members to form a generally cylindrical compact shape. The tail (not shown) is then wound around the folded kite to complete the package. In practice, the largest part of the collapsed kite is a hand reel and tether line for the kite. The complete package can be packed in an envelope for transportation and storage.

The kite is opened for use by unwinding the tail and opening the kite, attaching the line and by holding the kite in the wind by the tip in one hand which allows the kite to fly.

Thus, by this invention there is provided a foldable and packagable kite which does not require any preflight assembly to enable it to fly.

A particular example of the invention has been described and it is envisaged that improvements and modifications can take place.

I claim:

1. A collapsible and foldable kite including frame members, a keel member, spreader supports, and a sail, the frame members, the keel member, and spreader supports being fixed to the sail, the keel member and spreader supports being for bracing the sail while the sail is flying, the frame members including a main frame formed from at least two longitudinal members and two transverse members and a joint for forming a hinged connection of the two longitudinal and two transverse members, for enabling the frame members and sail to be folded so that an overall length of the frame is about a length of one of the transverse members after which the sail is rolled into a small package around the frame members.

2. A collapsible and foldable kite as claimed in claim 1 wherein the frame members are attached to the sail on a face thereof opposite to that which the keel member and spreader supports are fixed.

3. A collapsible and foldable kite as claimed in claim 2 wherein the sail is constructed from a plastic material which is heat welded or fixed with self-adhesive tape to the frame members.

4. A collapsible and foldable kite as claimed in claim 3 wherein the sail and frame members are formed from the same material.

5. A collapsible and foldable kite as claimed in claim 4 wherein the kite is square or diamond-shaped.

6. A collapsible and foldable kite as claimed in claim 5 wherein a plastic member is or plastic members are positioned over the frame members on the sail to position them together.

7. A collapsible and foldable kite as claimed in claim 5 wherein the keel member includes a towing connection to which a tether line is connected.

8. A collapsible and foldable kite as claimed in claim 7 wherein the sail is folded or collapsed in an umbrella fashion about the hinged joint between the frame member.

9. A collapsible and foldable kite as claimed in claim 7 together with pens or coloring means sold as a kit for purchasers to draw or color the sail to a desired pattern.

10. A collapsible and foldable kite as claimed in claim 2, wherein the frame members are manufactured from wood or a plastic material which can be formed, extruded or injection moulded with the hinged joint thereis.

11. A collapsible and foldable kite as claimed in claim 1 wherein there are three longitudinal members and means for forming an additional hinged joint between two of the longitudinal members.

12. A collapsible and foldable kite as claimed in claim 2 wherein the sail is glued to the frame members.

13. A collapsible and foldable kite including frame members, a keel member, spreader supports, and a sail, the keel member and spreader supports being fixed to the sail and frame members, the keel member and spreader supports being for bracing the sail while the sail is flying, the frame members including a main frame formed from at least two longitudinal members and two transverse members, and a joint for forming a hinged connection of the two longitudinal and two transverse members for enabling the frame members and sail to be folded so that an overall length of the frame is about a length of one of the transverse members after which the sail is rolled into a small package around the frame members.

14. A collapsible and foldable kite as claimed in claim 13 wherein the spreader supports are fixed to the sail in line contact along a substantial portion of a transverse length of the sail.

15. A collapsible and foldable kite as claimed in claim 13 wherein the frame members are manufactured from a plastic material and are slidingly engaged in an injection-molded connector formed with socket members into which the ends of members forming the frame members are fitted, the socket members are joined to a central hub by flexible webs which allow the socket members and the frame members to hinge to lie alongside each other.

16. A collapsible and foldable kite including frame members, a keel member, spreader supports, and a sail, the frame members including first, second, and third longitudinal members, first means for forming a first hinged joint between the first and second longitudinal members and second means for forming a second hinged joint between the second and third longitudinal members so that the first, second, and third longitudinal members are foldable into an overall length of only one of the longitudinal members, and the frame members include two transverse members attached to the first joint.

17. A collapsible and foldable kite as claimed in claim 1 wherein the spreader supports are fixed to the sail in line contact along a substantial portion of a transverse length of the sail.

18. A collapsible and foldable kite as claimed in claim 16 wherein the first joint means comprise means for hingedly attaching the two transverse members.

19. A collapsible and foldable kite as claimed in claim 16 wherein the first and second joint means enable the kite to fold to about one-third its longitudinal length and about one-half its transverse length.

20. A collapsible and foldable kite as claimed in claim 18 wherein the first and second joint means enable the kite to fold to about one-third its longitudinal length and about one-half its transverse length.

* * * * *